US007024877B2

(12) United States Patent
Yap

(10) Patent No.: US 7,024,877 B2
(45) Date of Patent: Apr. 11, 2006

(54) WATER HEATING SYSTEM

(75) Inventor: Zer Kai Yap, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/724,650

(22) Filed: Dec. 1, 2003

(65) Prior Publication Data

US 2005/0115260 A1 Jun. 2, 2005

(51) Int. Cl.
*F25B 27/00* (2006.01)
*F25B 7/00* (2006.01)

(52) U.S. Cl. ..... 62/238.6; 62/79; 237/2 B

(58) Field of Classification Search ..... 62/238.6, 62/79, 196.2, 184, 277, 510, 513; 237/2 B
See application file for complete search history.

(56) References Cited

U.S. PATENT DOCUMENTS

| | | | | |
|---|---|---|---|---|
| 4,474,018 | A * | 10/1984 | Teagan | 62/79 |
| 6,330,809 | B1 * | 12/2001 | Boardman et al. | 62/434 |
| 6,467,288 | B1 | 10/2002 | Kuroki et al. | 62/197 |
| 6,467,289 | B1 | 10/2002 | Kuroki et al. | 62/201 |
| 6,494,051 | B1 | 12/2002 | Sakakibara et al. | 62/225 |
| 6,508,073 | B1 | 1/2003 | Noro et al. | 62/238.6 |
| 6,729,151 | B1 * | 5/2004 | Thompson | 62/238.6 |
| 2002/0007943 | A1 | 1/2002 | Ozaki et al. | 165/202 |

FOREIGN PATENT DOCUMENTS

| | | | |
|---|---|---|---|
| JP | 04254154 | A * | 9/1992 |
| JP | 2003074997 | A * | 3/2003 |

* cited by examiner

*Primary Examiner*—Chen-Wen Jiang
(74) *Attorney, Agent, or Firm*—Baker & Daniels

(57) ABSTRACT

A water heating system including a water storage vessel; a water circuit; first and second heat exchangers operably disposed in the water circuit; and a vapor compression system defining a refrigerant circuit. The vapor compression system includes first and second compressor mechanisms. The first compressor mechanism compresses the refrigerant from suction pressure to intermediate pressure. The second compressor mechanism compresses the refrigerant from the intermediate pressure to a supercritical discharge pressure. The first heat exchanger is operably disposed in the refrigerant circuit between the first and second compressor mechanisms, and exchanges heat between intermediate pressure refrigerant and water. An expansion device is operably disposed in the refrigerant circuit. An evaporator is operably disposed in the refrigerant circuit between expansion device and first compressor mechanism. The second heat exchanger is operably disposed in the refrigerant circuit between second compressor mechanism and expansion device, and uses the supercritical refrigerant to heat water.

12 Claims, 4 Drawing Sheets

WATER HEATING SYSTEM

BACKGROUND OF THE INVENTION

1. Field of the Invention

The present invention relates to water heating systems and, more particularly, to a water heating system that employs a vapor compression system using carbon dioxide as the refrigerant.

2. Description of the Related Art

Water heating systems that utilize a heat pump cycle, i.e., a vapor compression system, having carbon dioxide as the refrigerant are known in the art. Such systems typically include a compressor that compresses carbon dioxide from suction pressure to a supercritical discharge pressure. The compression of the carbon dioxide to the discharge pressure elevates the temperature of the carbon dioxide. The hot, high pressure carbon dioxide is then supplied to a heat exchanger in which the carbon dioxide is cooled and water is heated.

Although such water heating systems are known, an improved water heating system that employs a vapor compression system having carbon dioxide as the working fluid is desirable.

SUMMARY OF THE INVENTION

The present invention provides a water heating system. The water heating system, in one form, includes a water storage vessel; a water circuit circulating water from at least one inlet in fluid communication with the storage vessel to at least one outlet in fluid communication with the storage vessel; a first heat exchanger operably disposed in the water circuit; at least one second heat exchanger operably disposed in the water circuit; and a vapor compression system defining a refrigerant circuit for circulating a refrigerant. The vapor compression system comprises a first compressor mechanism and a second compressor mechanism. The first compressor mechanism compresses a refrigerant from a suction pressure to an intermediate pressure. The second compressor mechanism compresses the refrigerant from the intermediate pressure to a discharge pressure. The refrigerant may advantageously be carbon dioxide which is compressed to a supercritical discharge pressure. The first heat exchanger is operably disposed in the refrigerant circuit between the first and second compressor mechanism wherein intermediate pressure refrigerant heats water circulating in the water circuit. An expansion device is operably disposed in the refrigerant circuit and reduces the pressure of the refrigerant. An evaporator is operably disposed in the refrigerant circuit between the expansion device and the first compressor mechanism. The at least one second heat exchanger is operably disposed in the refrigerant circuit between the second compressor mechanism and the expansion device wherein refrigerant heats water in the fluid circuit.

In a related embodiment, the vapor compression system further comprises an internal heat exchanger that transfers thermal energy between refrigerant at a first location and refrigerant at a second location. The first location is disposed between the at least one second heat exchanger and the expansion device, and the second location is disposed between the evaporator and the first compression mechanism.

The present invention also provides a method of heating water. The method comprises the steps of providing a water storage vessel; providing a first compressor mechanism and a second compressor mechanism; compressing a refrigerant comprising carbon dioxide from a suction pressure to an intermediate pressure in the first compressor mechanism; compressing the refrigerant from the intermediate pressure to a supercritical discharge pressure in the second compressor mechanism; circulating water through a first heat exchanger such that the water is heated by the intermediate pressure refrigerant in the first heat exchanger; communicating the heated water to the storage vessel; circulating water through a second heat exchanger such that the water is heated by the supercritical pressure refrigerant in the second heat exchanger; and communicating the water heated in the second heat exchanger to the storage vessel.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
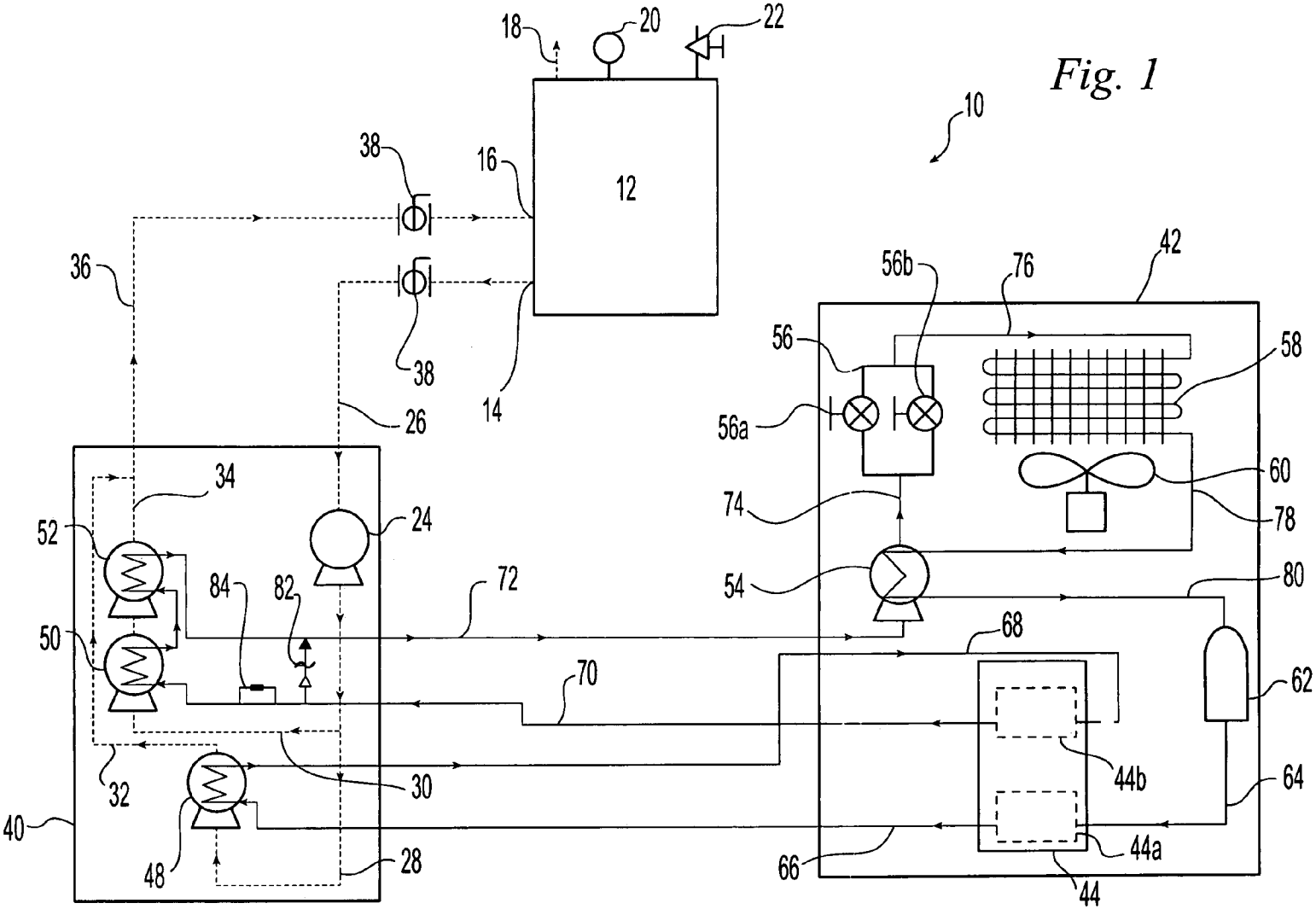
FIG. 1 is a schematic diagram of a water heating system according to one embodiment of the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DESCRIPTION OF THE PRESENT INVENTION

Figure 2:
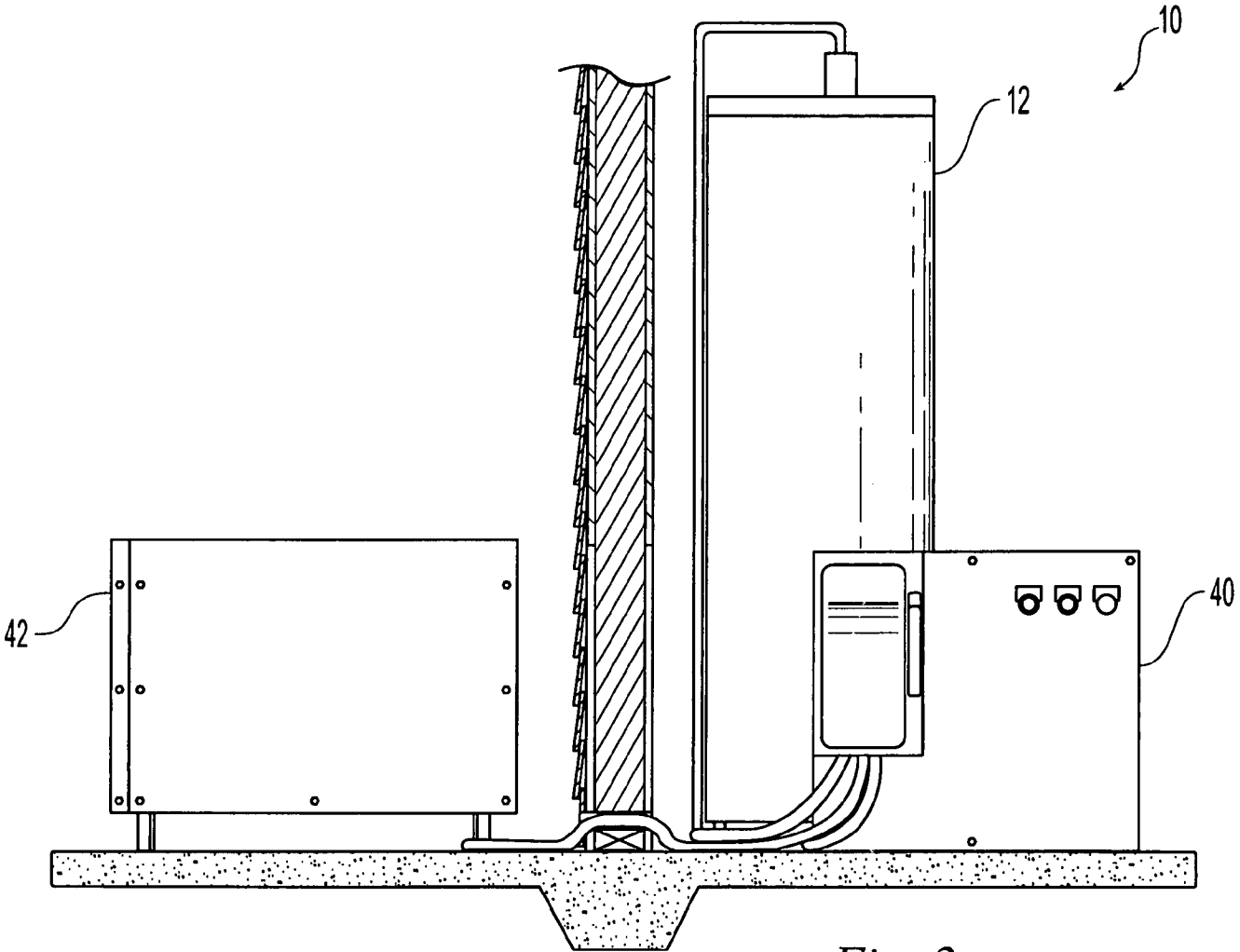
FIG. 2 is a side view of a water heating system according to one embodiment of the present invention.

Referring now to the drawings and particularly to FIGS. 1 and 2, there is shown a water heating system 10 that includes a water circuit and a vapor compression system. The water circuit, generally represented by dashed lines, includes a water storage vessel 12 and a water circulation system that extends through a heat exchanging module 40 that includes pump 24 and heat exchangers 48, 50, 52, and returns to water storage vessel 12 as described in greater detail below.

As illustrated in FIG. 2, the water storage vessel 12 and heat exchanging module 40 can be housed in the interior of a building while compressor and evaporator module 42 may be located outside the building. The vapor compression system defines a refrigerant circuit, generally represented by solid lines, that includes a two stage compressor 44 and intercooler 48, heat exchangers 50, 52, internal heat exchanger 54, expansion device 56, heat exchanger 58 and suction accumulator 62 as described in greater detail below.

Water storage vessel 12 may be any water storage vessel suitable for storing hot water. Water storage vessel 12 includes outlet 14 and inlet 16 by which water respectively enters and exits the water circuit including heat exchanging module 40. Water storage vessel 12 also includes hot water outlet 18 by which hot water exits water storage vessel 12 and flows to the point of use. A water supply line (not shown) supplies unheated water to storage vessel 12.

Water storage vessel 12 may also include thermostat 20. As discussed in greater detail below, thermostat 20 can be used to monitor the temperature within water storage vessel 12 and control the operation of water heating system 10. In the illustrated embodiment, water storage vessel 12 also includes a manually operated air vent 22 that can be used to provide communication between the interior of tank 22 and the surrounding environment when draining and servicing water storage vessel 12.

Figure 4:
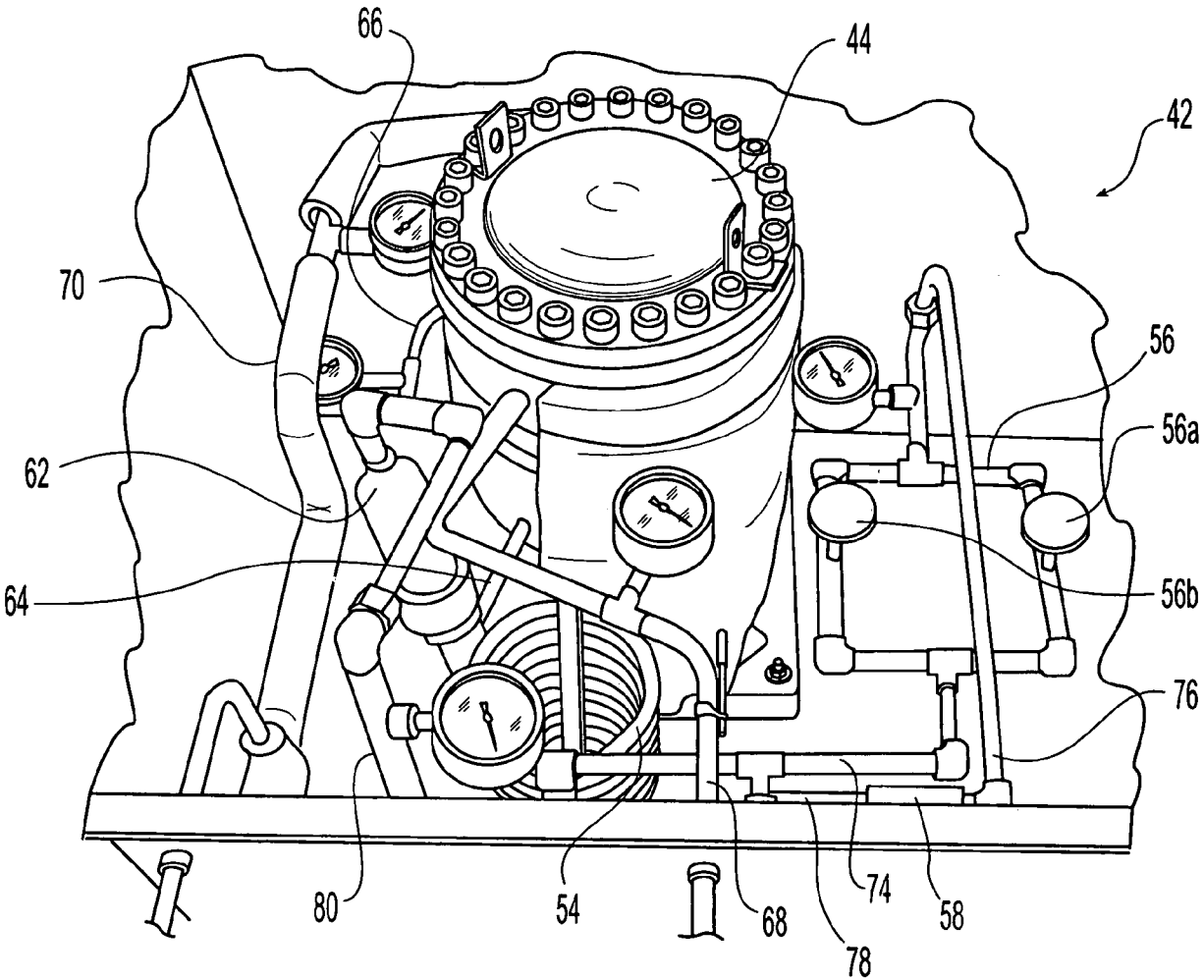
FIG. 4 is a perspective view of the compressor and evaporator module of the water heating system of FIG. 2.

Referring now to FIGS. 1 and 4, vapor compression system 42 includes two-stage compressor 44, which comprises first-stage compressor mechanism 44*a* and second-stage compressor mechanism 44*b*. The compressor stages 44*a*, 44*b* may be any suitable type of compressor mechanism including rotary, reciprocating piston and/or scroll compressor mechanisms.

Also included in the compressor and evaporator module 42 is an internal heat exchanger 54, expansion device 56, evaporator 58, blower 60, and suction accumulator 62. Internal heat exchanger 54 takes the form of a dual heat transfer coil having a tube within tube construction. Internal heat exchanger 54 is in fluid communication with the refrigeration circuit at two locations along the refrigeration circuit. First, the internal tube of heat exchanger 54 communicates with the refrigeration circuit at a location between heat exchanging module 40 and the inlet side of expansion device 56. The external tube of heat exchanger 54 communicates with the refrigerant circuit at a second location between evaporator 58 and suction accumulator 62.

Expansion device 56 is in fluid communication with the refrigeration circuit between internal heat exchanger 54 and evaporator 58. In the illustrated embodiment, expansion device 56 takes the form of two expansion valves 56*a*, 56*b* arranged in parallel, however, alternative configurations may also be used with the present invention. Evaporator 58 is a micro-channel evaporator 58 and includes a series of coils through which the refrigerant flows. Evaporator 58 is in communication with the refrigeration circuit between the outlet side of expansion device 56 and internal heat exchanger 54. As shown in FIG. 1, blower 60 is positioned adjacent to the evaporator 50 and pulls air across the coils of evaporator 58. As illustrated in FIGS. 1 and 4, suction accumulator 62 is in communication with the refrigeration circuit between internal heat exchanger 54 and compressor 44. Accumulator 62 separates liquid and gas phase refrigerant to limit or prevent liquid phase refrigerant from entering first-stage compressor mechanism 44*a*.

Figure 3:
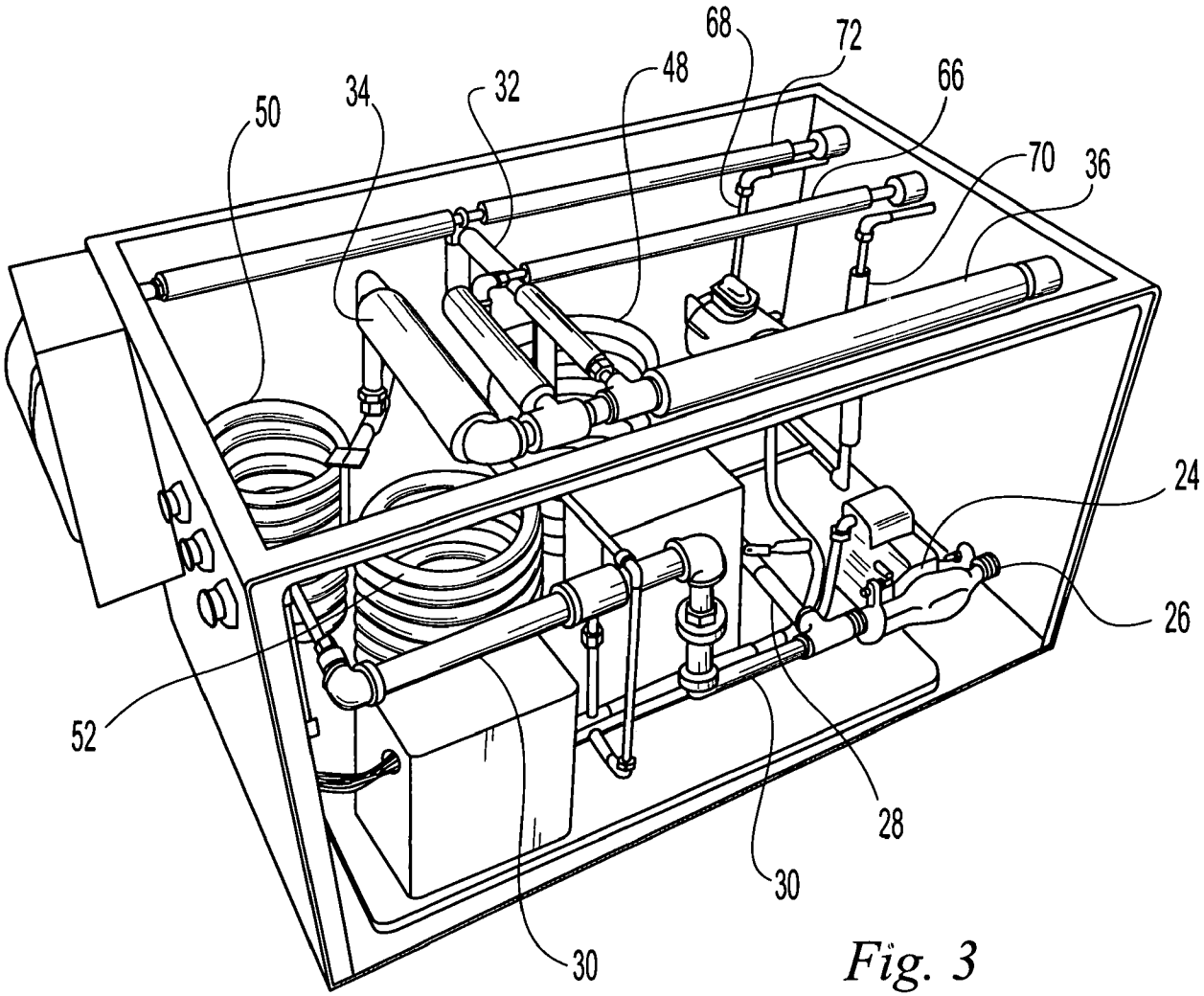
FIG. 3 is a perspective view of the heat exchanging module of the water heating system of FIG. 2.

Referring now to FIGS. 1 and 3, heat exchanging module 40 includes intercooler heat exchanger 48, primary heat exchanger 50, and secondary heat exchanger 52. Heat exchangers 48, 50 and 52 are fluidly connected to water storage vessel 12, as illustrated by the dashed lines representing the water circuit, and to the vapor compression system. Each of heat exchangers 48, 50, 52 comprises dual heat transfer coils having a tube within tube construction. The internal tube of heat exchangers 48, 50, 52 is in communication with, and forms a part of, the refrigerant circuit while the external tube of the heat exchangers 48, 50, 52 is in communication with, and forms a part of the water heating circuit. The internal tube of intercooler heat exchanger 48 is in fluid communication with the refrigerant circuit at a position between first-stage compression mechanism 44*a* and second-stage compression mechanism 44*b* while primary and secondary heat exchangers 50, 52 are arranged in series in the refrigeration circuit at a position between second-stage compression mechanism and expansion device 56. While the illustrated embodiment of heating system 10 includes two heat exchangers 50, 52 that function as both gas coolers for the refrigerant and water heating units, a single heat exchanger could be used in place of heat exchangers 50, 52, or multiple heat exchangers could be employed and arranged in parallel and/or in series.

Referring now to FIGS. 1 and 3–4, the refrigeration circuit will now be described in further detail. The refrigeration circuit includes first-stage suction line 64 fluidly connecting suction accumulator 62 to first-stage compression mechanism 44*a*. A first-stage discharge line 66 fluidly connects first-stage compressor mechanism 44*a* to heat exchanger 48. From first-stage heat exchanger 48 second-stage suction line 68 communicates fluid to second-stage compressor mechanism 44*b*. A discharge line 70 fluidly connects second-stage compressor mechanism 44*b* to primary and secondary heat exchangers 50, 52 which are arranged in series. Refrigerant line 72 fluidly connects secondary heat exchanger 52 to internal heat exchanger 54. A pressure relief valve 82 and a pressure relief switch 84 are positioned on discharge line 70. Pressure relief valve 82 is used to vent refrigerant to the environment if the pressure within line 70 exceeds a predetermined value. Pressure switch 84 is coupled to the power supply for compressor 44 and interrupts the power to compressor 44 if the pressure within line 70 exceeds a predetermined value. The pressure at which pressure switch 84 interrupts power to compressor 44 is advantageously less than the pressure at which valve 82 vents refrigerant.

Internal heat exchanger 54 is fluidly connected to expansion device 56 via refrigerant line 74. Refrigerant line 76 extends from expansion device 56 to evaporator 58. Line 78 fluidly connects evaporator 58 to internal heat exchanger 54, and refrigerant line 80 fluidly connects internal heat exchanger 54 to suction accumulator 62. The pipes used in constructing refrigeration circuit may be of any size and material suitable for withstanding the temperatures and pressures of the refrigerant conveyed within the pipes. Advantageously, the refrigerant lines used within the vapor compression system are stainless steel pipes. One or more of the refrigerant lines 66, 68, 70 may also be insulated to improve the efficiency of the water heating system.

Referring now to FIGS. 1 and 3, the water circuit will now be described in further detail. The water heating circuit includes main water circulation line 26, which is fluidly connected at one end to water storage vessel 12 via outlet 14. Water is drawn from vessel 12 through line 26 by water circulation pump 24. At its opposite end, main water circulation line 26 branches into first heat exchanger inlet line 28 and second heat exchanger inlet line 30. First inlet line 28 communicates with heat exchanger 48, while second inlet line 30 communicates in series with primary and secondary heat exchangers 50, 52. First heat exchanger outlet line 32 exits first-stage heat exchanger 48 and second heat exchanger outlet line 34 exits secondary second-stage heat exchanger 52. Outlet lines 32 and 34 merge to form main water return line 36, which communicates with water storage vessel 12 via inlet 16. In the illustrated embodiment, ball valves 38 are located in water return line 36 and water line 26 to isolate water storage tank 12 from heat exchanging module 40 to facilitate the maintenance and repair of heat exchanging module 40. The piping used in the water circuit may be standard copper piping. Other suitable piping may also be used. The piping and storage vessel 12 of the water circuit are advantageously insulated to limit heat loss.

Referring now to FIGS. 1 and 3–4, in operation, a refrigerant, such as carbon dioxide, is drawn into first-stage compression mechanism 44*a* at a suction pressure and a suction temperature via suction line 64. The refrigerant is compressed by first-stage compression mechanism 44*a* from a suction pressure to an intermediate pressure. The compressing of the refrigerant in compression mechanism 44*a* to the intermediate pressure also elevates the temperature of the refrigerant. The warm, intermediate pressure refrigerant is discharged from first-stage compression mechanism 44*a* into intermediate pressure line 66 which conveys the refrigerant to heat exchanger 48. In the illustrated embodiment, the intermediate pressure refrigerant flows through the internal tube of heat exchanger 48 and is cooled by water circulated through the external tube of heat exchanger 48.

Water from water storage vessel 12 is drawn by circulation pump 24 from storage vessel 12 via water circulation outlet 14 into main water circulation line 26. The water then flows from main water circulation line 26 into both first and second heat exchanger inlet lines 28, 30. The water from first heat exchanger inlet line 28 enters and flows through the external tube of first stage heat exchanger 48 in a direction counter to the flow of the refrigerant within the internal tube. Thermal energy is transferred from the refrigerant in the internal tube to the water in the external tube, thereby heating the water and cooling the intermediate pressure refrigerant gas. Thus, first-stage heat exchanger 48 acts as both an intercooler, cooling the intermediate pressure refrigerant, and as a water heater, raising the temperature of water that is returned to water storage vessel 12.

The intermediate pressure refrigerant exits heat exchanger 48 and flows to second-stage compression mechanism 44*b* via intermediate pressure line 68. Second-stage compression mechanism 44*b* further compresses the intermediate pressure refrigerant to a supercritical discharge pressure. Compressing the refrigerant in compression mechanism 44*b* also elevates the temperature of the supercritical refrigerant. The hot high pressure refrigerant is discharged from second-stage compression mechanism 44*b* into high pressure line 70 which conveys the refrigerant to primary and secondary heat exchangers 50, 52 which are arranged in series. In the illustrated embodiment, the hot high pressure refrigerant is conveyed through the internal tube of each of primary and secondary heat exchangers 50, 52.

Water from line 30 enters and flows through the external tube of each of primary and secondary heat exchangers 50, 52 in a direction counter to the flow of the refrigerant within the internal tube. As in first-stage heat exchanger 48, heat is transferred in primary and secondary heat exchangers 50, 52, primarily by conduction through the internal tube wall, from the refrigerant flowing within the internal tube to the water flowing in the external tube. Thus, the second-stage heat exchangers 50, 52 cool the high pressure refrigerant and raise the temperature of the water. In the illustrated embodiment, carbon dioxide is employed as the refrigerant and is compressed to a supercritical pressure in second compression mechanism 44*b*. Thus, heat exchangers 50, 52 act as a gas cooler when cooling the supercritical carbon dioxide refrigerant. If an alternative refrigerant that did not require compression to a supercritical pressure, heat exchangers 50, 52 would function as a conventional condenser. The water heated in secondary heat exchanger 52 is discharged into line 34 while the heated water from heat exchanger 48 is discharged into line 32. Each of the water lines 32, 34 feed the heated water into main water return line 36, which communicates the heated water to water storage vessel 12 via inlet 16.

The high pressure refrigerant exits secondary heat exchanger 52 and returns to module 42 via refrigerant line 72. More specifically, the high pressure refrigerant flows through line 72 and enters the internal tube of internal heat exchanger 54 where the high pressure refrigerant is further cooled. The high pressure refrigerant exits internal heat exchanger 54 and flows to expansion device 56 via line 74. At expansion device 56, the pressure of the refrigerant is reduced by conventional expansion valves 56*a*, 56*b*. Low pressure refrigerant line 76 communicates the refrigerant to evaporator 58, where the low pressure refrigerant evaporates and absorbs thermal energy from the air drawn over the evaporator coils by blower 60. Additional thermal energy is imparted to the low pressure refrigerant in internal heat exchanger 54. Refrigerant line 78 conveys the relatively cool low pressure refrigerant from evaporator 58 to internal heat exchanger 54. The low pressure refrigerant flows through the external tube of internal heat exchanger 54 in a direction counter to the flow of the high pressure refrigerant in the internal tube and heat is transferred from the high pressure refrigerant to the low pressure refrigerant. As a result, the low or suction pressure refrigerant is pre-heated prior to entering compressor 44. The suction pressure refrigerant is conveyed from internal heat exchanger 54 to suction accumulator 62 via refrigerant line 80. Suction accumulator 62 separates condensation, i.e., liquid phase refrigerant, from the gas phase refrigerant before the refrigerant returns to the inlet of first stage compressor mechanism 44*a* via refrigerant line 64. The refrigerant is then circulated again through the vapor compression system.

Water storage vessel 12 is used to store heated water so that is available through water line 18 upon demand. To maintain the water within storage vessel 12 at a desired temperature and to elevate the temperature of unheated water entering vessel 12 to replenish water discharged through water line 18 to a point of use, the water within storage vessel 12 may be recirculated continuously through the heat exchanging module 40. Alternatively, the water in vessel 12 may be circulated through heat exchanging module 40 based upon the temperature of the water in storage vessel 12. For example, a thermostat 20 may be mounted on storage vessel 12 to sense the temperature of the water within vessel 12. Thermostat 20 may also control the power supply to both pump 24 and compressor 44 wherein the thermostat 20 activates both pump 24 and compressor 44 when the temperature of the water within vessel 12 falls below a predefined temperature. Thermostat 20 would then deactivate pump 24 and compressor 44 when the temperature of the water within vessel 12 reached a second predefined temperature. The predefined temperatures defining when water is circulated by pump 24 through heat exchanging module 40 could be set such that pump 24 substantially continuously circulates water through heat exchanging module 40. The quantity and frequency of hot water removed from vessel 12 through water line 18 and the storage capacity of vessel 12 may all influence the optimum settings for thermostat 20. The use of such a thermostat to control the activation and deactivation of a water heating system utilizing a vapor compression system is known to those having ordinary skill in the art.

Alternative embodiments could employ additional controls, sensors and valves to more precisely control the operation of system 10, however, such additional features would increase the cost of the system. For example, it would possible for system 10 to include an electronic control unit and electronically controlled valves in water lines 28 and 32 to allow water to be pumped through heat exchangers 50, 52 without any water being pumped through intercooler 48. The electronic control unit might also receive signals from one or more temperature and pressure sensors disposed on the vapor compression system and be programmed to allow or prevent the circulation of water through heat exchanger 48 to promote the efficient operation of the vapor compression system.

While this invention has been described as having an exemplary design, the present invention may be further modified within the spirit and scope of this disclosure. This application is therefore intended to cover any variations, uses, or adaptations of the invention using its general principles.

What is claimed is:

1. A water heating system comprising:

a water storage vessel;

a water circuit circulating water from at least one inlet in fluid communication with said storage vessel to at least one outlet in fluid communication with said storage vessel;

a first heat exchanger and a second heat exchanger operably disposed in said water circuit, said first heat exchanger and said second heat exchanger arranged in parallel;

a vapor compression system defining a refrigerant circuit for circulating a refrigerant, said vapor compression system including a first compressor mechanism and a second compressor mechanism, said first compressor mechanism compressing a refrigerant from a suction pressure to an intermediate pressure, said second compressor mechanism compressing the refrigerant from the intermediate pressure to a discharge pressure;

said first heat exchanger being operably disposed in said refrigerant circuit between said first and second compressor mechanisms wherein intermediate pressure refrigerant heats water in said water circuit;

an expansion device operably disposed in said refrigerant circuit, reducing the pressure of said refrigerant;

an evaporator operably disposed in said refrigerant circuit between said expansion device and said first compressor mechanism; and wherein said second heat exchanger is operably disposed in said refrigerant circuit between said second compressor mechanism and said expansion device wherein discharge pressure refrigerant heats water in said fluid circuit.

2. The water heating system of claim 1 wherein said vapor compression system further comprises a refrigerant heat exchanger transferring thermal energy between refrigerant at first and second locations, said first location disposed between said second heat exchanger and said expansion device, said second location disposed between said evaporator and said first compression mechanism.

3. The water heating system of claim 1 wherein said second heat exchanger includes a primary heat exchanger and a secondary heat exchanger.

4. The water heating system of claim 3 wherein said primary and secondary heat exchangers are disposed in series in said refrigerant circuit.

5. The water heating system of claim 1 wherein said refrigerant comprises carbon dioxide and said second compressor mechanism compresses said refrigerant to a supercritical discharge pressure.

6. The water heating system of claim 1 further comprising at least one pressure relief valve operably disposed in said refrigerant circuit between said second compressor mechanism and said expansion device.

7. The water heating system of claim 1 wherein said water storage vessel, said first heat exchanger and said second heat exchanger are disposed in a building interior and wherein said first and second compressor mechanisms and said evaporator are disposed in an exterior location.

8. The water heating system of claim 1 further comprising a pump positioned in said water circuit, said pump circulating water through said water circuit.

9. A method of heating water, said method comprising the steps of:

providing a water circuit including a water storage vessel, and first and second heat exchangers arranged in parallel within the water circuit;

providing a first compressor mechanism and a second compressor mechanism;

compressing a refrigerant comprising carbon dioxide from a suction pressure to an intermediate pressure in said first compressor mechanism;

compressing the refrigerant from the intermediate pressure to a supercritical discharge pressure in said second compressor mechanism;

circulating water through the first heat exchanger, heating the water with the intermediate pressure refrigerant in said first heat exchanger, and communicating the water heated in said first heat exchanger to said storage vessel; and circulating water through the second heat exchanger, heating the water with the supercritical pressure refrigerant in said second heat exchanger, and communicating the water heated in said second heat exchanger to said storage vessel.

10. The method of claim 9 further comprising:

reducing the pressure of the refrigerant in an expansion device after cooling the refrigerant in the second heat exchanger;

heating the refrigerant in an evaporator after reducing the pressure of the refrigerant in the expansion device; and communicating the refrigerant to said first compressor mechanism after heating the refrigerant in said evaporator.

11. The method of claim 10 further comprising the step of exchanging thermal energy in a refrigerant heat exchanger having a first refrigerant passageway operably disposed between said second heat exchanger and said expansion device and a second refrigerant passageway operably disposed between said evaporator and said first compression mechanism.

12. A method of heating water, comprising the steps of:

providing a water circuit including a water storage vessel, and first and second heat exchangers arranged in parallel within the water circuit;

providing a first compressor mechanism and a second compressor mechanism;

compressing a refrigerant from a suction pressure to an intermediate pressure in said first compressor mechanism;

compressing the refrigerant from the intermediate pressure to a discharge pressure in said second compressor mechanism;

circulating water through the first heat exchanger, heating the water with the intermediate pressure refrigerant in the first heat exchanger, and communicating the water heated in the first heat exchanger to the storage vessel; and circulating water through the second heat exchanger, heating the water with the discharge pressure refrigerant in the second heat exchanger, and communicating the water heated in the second heat exchanger to the storage vessel.

* * * * *